United States Patent [19]

Sulecki et al.

[11] Patent Number: 5,020,757

[45] Date of Patent: Jun. 4, 1991

[54] LADDER JACK CLAMPING DEVICES

[75] Inventors: Richard P. Sulecki, Transfer; Stanley A. Kiska, Greenville, both of Pa.

[73] Assignee: R. D. Werner Co., Inc., Greenville, Pa.

[21] Appl. No.: 62,104

[22] Filed: Jun. 15, 1987

[51] Int. Cl.[5] ..... E04G 5/00

[52] U.S. Cl. ..... 248/238; 248/500; 182/121

[58] Field of Search ..... 248/238, 500, 507, 509, 248/510; 182/120–122, 119, 117

[56] References Cited

U.S. PATENT DOCUMENTS

| | | | |
|---|---|---|---|
| 1,143,678 | 6/1915 | Winans | 248/238 |
| 1,474,462 | 11/1923 | Blankenhagen | 182/121 |
| 1,835,728 | 12/1931 | Urfer | 220/3.5 X |
| 2,783,963 | 3/1957 | Kalberg | 248/507 |
| 3,787,024 | 1/1974 | Dzus, Jr. | 248/507 X |
| 4,074,792 | 2/1978 | Zaugg et al. | 182/117 X |
| 4,199,072 | 4/1980 | Jacks | 248/507 X |
| 4,338,036 | 7/1982 | DeLeu | 403/370 X |

FOREIGN PATENT DOCUMENTS

| | | | |
|---|---|---|---|
| 943556 | 5/1956 | Fed. Rep. of Germany | 182/117 |
| 1332079 | 12/1963 | France | 182/117 |
| 1424744 | 12/1965 | France | 248/507 |
| 8055 | of 1912 | United Kingdom | 248/238 |

*Primary Examiner*—Alvin C. Chin-Shue

*Attorney, Agent, or Firm*—J. Helen Slough

[57] ABSTRACT

A ladder jack supported by an inclined ladder and adapted to securely support a work platform comprising a horizontal support member fitted with a longitudinally adjustable clamping means to securely clamp the work platform in locking engagement with the ladder jack and prevent movement of the work platform in all directions and planes while in use.

4 Claims, 3 Drawing Sheets

LADDER JACK CLAMPING DEVICES

BACKGROUND OF THE INVENTION

This invention pertains to ladder jacks supported by portable inclined ladders in a ladder scaffolding system comprising two or more laterally spaced inclined ladders, where the ladder jacks support a work platform or stage suspended between adjacent inclined ladders, and particularly to ladder jacks having means for securing the work platform to prevent movement thereof in all directions.

Ladder jacks are known for supporting work platforms between inclined ladders adapted to lean against a building or the like for work purposes. In such ladder arrangements, movement of the work platform in any direction results in an unstable mounting as unexpected forces or impacts in use cause the work platform to move laterally parallel to the building, and/or cause longitudinal movement of the work platform toward or away from the building, or dangerous upward movement due to unbalanced pivotal movement of the work platform. To prevent longitudinal movement of the work platform various means have been suggested, as for instance described and shown in U.S. Pat. Nos. 4,542,874, 2,665,952 and 1,143,678. In said prior art the horizontally disposed supporting member of the ladder jack carries an upright stop at the distal end thereof to prevent longitudinal sliding movement of the work platform relative to the support member. Upright stops, however, merely limit the longitudinal inward-outward movement of the work platform but do not secure the platform and prevent movement thereof in any direction. An early patent, U.S. Pat. No. 567,755 to Stillman patented Sept. 15, 1896, discloses a rocker plate supporting a work plank where the object is to allow for "give" of the work plank when weight is placed upon the work plank. Another early patent, U.S. Pat. No. 596,151 patented Dec. 28, 1897, discloses a vertical ladder permanently secured to the side wall of a building and provided with a bar with means for adjustably securing the bar to the ladder and having a bootboard permanently affixed to a horizontally disposed supporting member. A hook for adjusting a ladder jack with reference to the ladder rungs is disclosed in U.S. Pat. No. 2,910,135 where the distal end of the hook abuts adjacent work platforms but the work platform is not secured to the ladder jack. In U.S. Pat. No. 1,462,086 the foot support is attached to a ladder rung to prevent foot strain and fatigue occasioned by the user standing on a ladder rung for long periods of time. However, none of the said patents disclose effective means for selectively temporarily securing a work platform to a ladder jack to prevent movement of the work platform in all directions while in use.

It now has been found that a ladder jack for use with an inclined ladder to support a work platform between two or more laterally adjacent ladders can be easily assembled or dismantled and still maintain secure attachment of the work platform to the ladder jack in use. In accordance with this invention, the ladder jack is provided with longitudinally movable clamping means adapted to lock the work platform to a horizontally disposed support member of the ladder jack to effectively prevent movement of the work platform in all directions and in all planes including longitudinally inwardly and outwardly movement relative to the building, laterally left or right parallel movement relative to the building, as well as upward pivotal movement relative to the horizontal plane of the work platform supported by the ladder jack. The ladder jack of this invention is adapted to be supported by an inclined portable ladder and comprises a horizontal support member for supporting the work platform, an adjustable diagonal brace for maintaining the support members in a horizontal plane relative to the incline of the ladder, the horizontal support member containing clamping means for removably securing a work platform to the horizontal support member. The improved clamping means is adapted to be moved longitudinally inwardly and outwardly along the horizontal support member to provide locking engagement of variable width work platforms to the horizontal support member to thereby prevent relative movement of the platform in all directions and all planes. In addition to securing the work platform in a safe manner, the ladder jack can be advantageously assembled with portable lean-to ladders and elongated work platforms to provide portable scaffolding systems and then disassembled for easy transportation to another work site. The ladder jack is simple in construction and can be easily assembled or dismantled without tools These and other advantages of this invention will become more apparent by referring to the drawings and detailed description of the invention.

SUMMARY OF THE INVENTION

Briefly, the ladder jack of this invention is supported by a portable inclined ladder and comprises a horizontal support member fitted with a longitudinally movable clamping means adapted to provide locking engagement of the work platform with the horizontal support member to prevent movement thereof in all directions and in all planes.

IN THE DRAWINGS

DETAILED DESCRIPTION OF THE INVENTION

Figure 1:
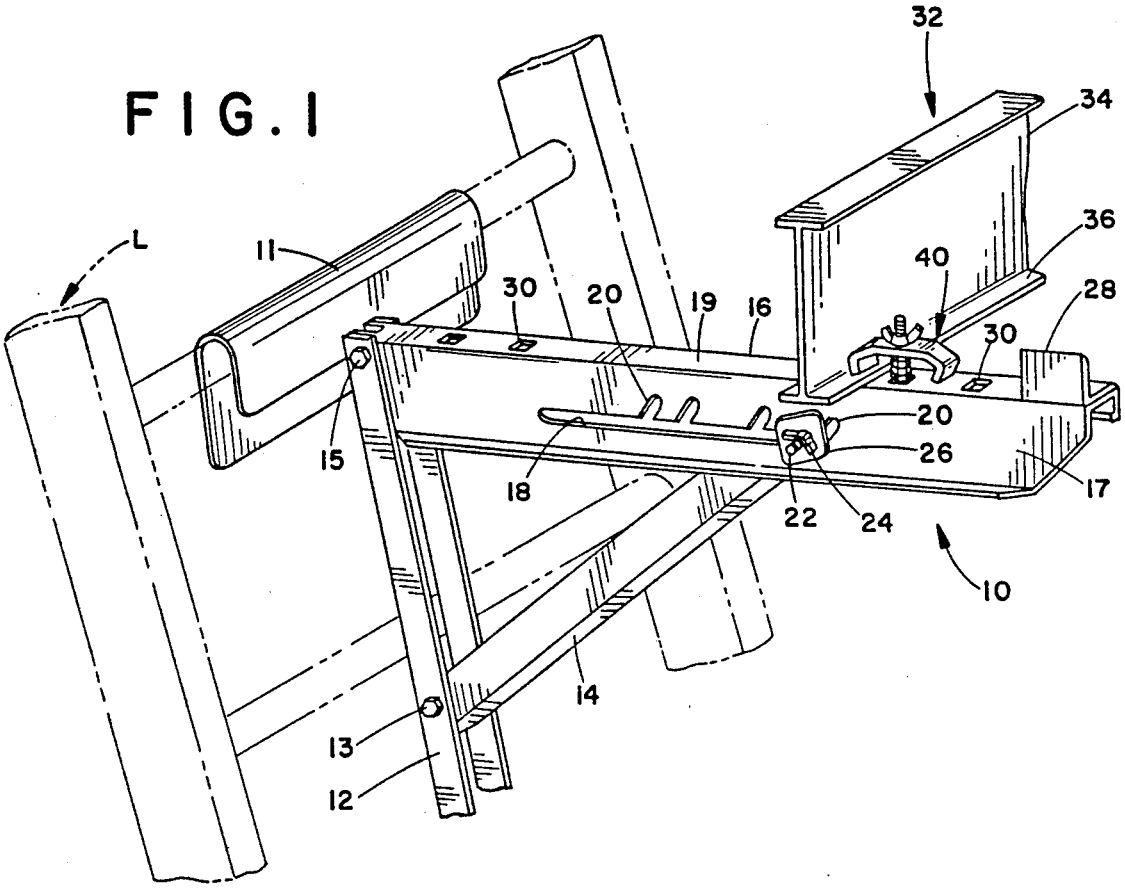
FIG. 1 is a perspective view of the ladder jack of this invention supported by a ladder shown in phantom lines, the ladder jack being illustrated as supporting an outside partial rail section of a work platform clamped to the ladder jack.

Referring now to the drawings, wherein like reference characters designate like parts, a ladder jack 10 having a rung bracket 11 is shown secured to the ladder adapted to engage a ladder rung and be supported by a ladder "L" shown in phantom lines in FIG. 1.

The ladder jack 10 comprises a vertical post 12 having a pivotal connection 13 with a diagonal brace member 14 adjustably interconnected to a horizontal support 16 adapted to support a work platform 32. The horizontal support 16 is further connected to the uppermost portion of the vertical post 12 at a pivot connection 15 to provide horizontal adjustment of the horizontal support 16 relative to the incline of the ladder "L" in use. To enable this adjustment, the diagonal brace 14 is adjustably connected to horizontal support member 16 by a lateral slot 18 disposed in a side wall 17 of the horizontal support member 16. The lateral slot 18 further extends into a plurality of upwardly extending adjustment slots 20 adapted to engage a threaded through-bolt 22 engaging a wing nut 24 attached to the upper part of the diagonal brace 14. Horizontal adjustment relative to the inclined ladder "L" can be secured by locating the through-bolt 22 within one of the adjustment slots 20 and then tightening the wing nut 24 to engage a locking washer 26 against the side wall 17. Although not shown, it can be appreciated that the horizontal support 16 can be used on the opposite side of the ladder "L" shown in FIG. 1 and FIG. 2 by reversing rung bracket 11 on ladder "L" and adjusting the position of bolt 22 in slot 20.

A plurality of longitudinally spaced holes 30 are vertically disposed through the upper wall 19 of the horizontal support member 16 to provide longitudinal adjustment of the clamping assembly 40 with one of the holes 30 to secure the work platform 32 to the horizontal support member 16 in accordance with this invention. The longitudinally spaced multi-hole 30 feature in the horizontal support member 16 allows variable positioning of the clamping assembly 40 with respect to the work platform for engaging platforms of different widths. The clamping assembly shown may be tightened or loosened, as the case may be, by rotating a threaded member.

Referring to FIG. 1, the clamping assembly 40 forceably engages an outside rail 34 of the work platform 32 by engaging the lower flange 36. As best viewed in FIG. 3, the clamping assembly 40 comprises an inverted C-shaped clamp 42 having inwardly tapered tips 41 for engagement with the rail 34 and contains a central hole 44 fitted with a square-neck threaded carriage bolt 46 in threaded engagement with a wing nut 48 to tighten or loosen the clamping engagement of the C-clamp 42 with a rail flange 36 of the work platform 32. As best viewed in FIG. 3, the square-neck head 47 of the carriage bolt 46 engages a square hole 30 located in the upper wall 19 whereby the carriage bolt 46 is maintained stationary while the wing nut 48 can be rotated to tighten or loosen as desired. Preferably, a light compression spring member 51 is interposed between the upper wall 19 of the horizontal support member 16 and the underside of the inverted C-clamp 42, as best viewed in FIG. 5, to ensure that the square head 47 of the carriage bolt 46 remains stationary in non-rotational engagement within the square hole 30 while the wing nut 48 is rotated. It is readily seen that the lower flange 36 of the outside rail 34 of the work platform 32 can be slid beneath the outer tip of the inverted C-clamp 42 and the wing nut 48 tightened downwardly until the outside rail 34 is tightly secured to the ladder jack 10.

Figure 2:
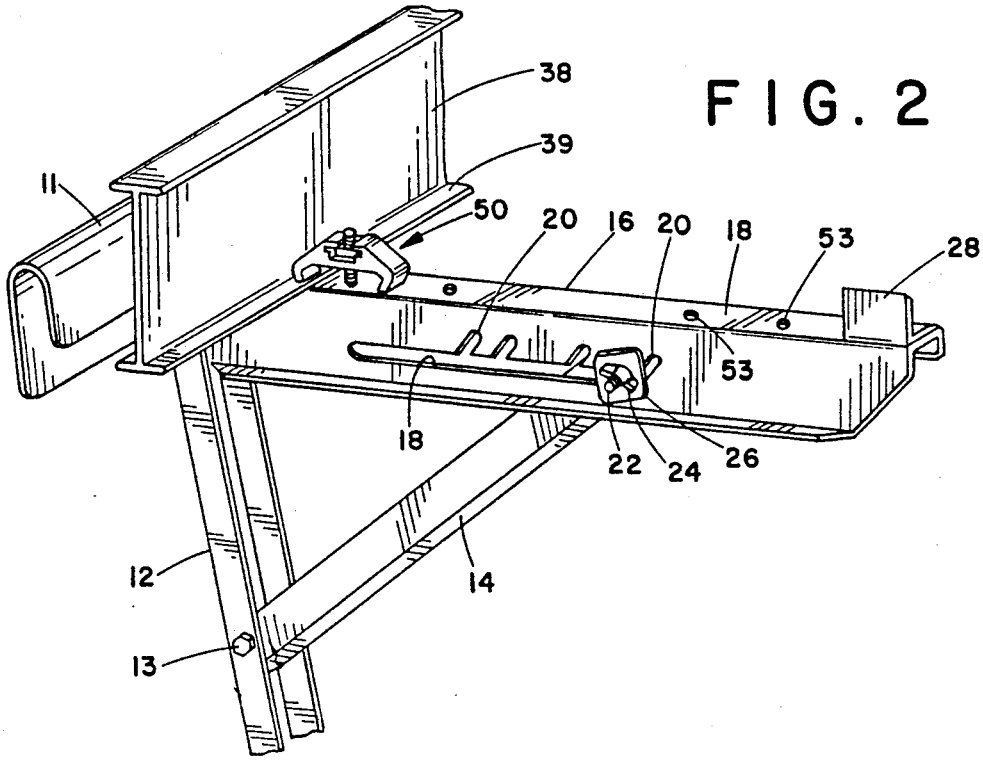
FIG. 2 is a perspective view similar to the view of FIG. 1 and shows an inside partial rail of a platform secured to the ladder jack by a second type of clamping assembly.

In FIG. 2 a further embodiment of the clamping assembly in accordance with this invention is shown and clamping assembly 50 engages an inside rail flange 39 of the work platform 32. In this embodiment, best viewed in FIG. 4, the clamping assembly 50 comprises an inverted C-clamp 52 fitted with a threaded member assembly, a central nut 54 secured within the inverted C-clamp 52 structure adapted to engage a threaded bolt 56 passing through a cylindrical opening within the C-clamp 52 in alignment with the nu 54 and passing through a circular hole 53 located in the horizontal support member 16. The threaded bolt 56 can be welded or otherwise secured to means such as T-handle 58 whereby the inverted C-clamp 52 can be tightened or loosened by rotating the T-handle 58 while the bolt 56 and C-clamp 52 in this form of the invention engage the lower flange 39 of the inside rail 38 of the work platform 32. As best viewed in FIG. 4 and FIG. 6, the square nut 54 is disposed within a recessed slot 60 and each upper surface corner 62 of the C-clamp adjacent to the recessed slot 60 is crimped downwardly to impinge upon the nut 54 to permanently lock the square nut 54 within the slot 60.

Figure 7:
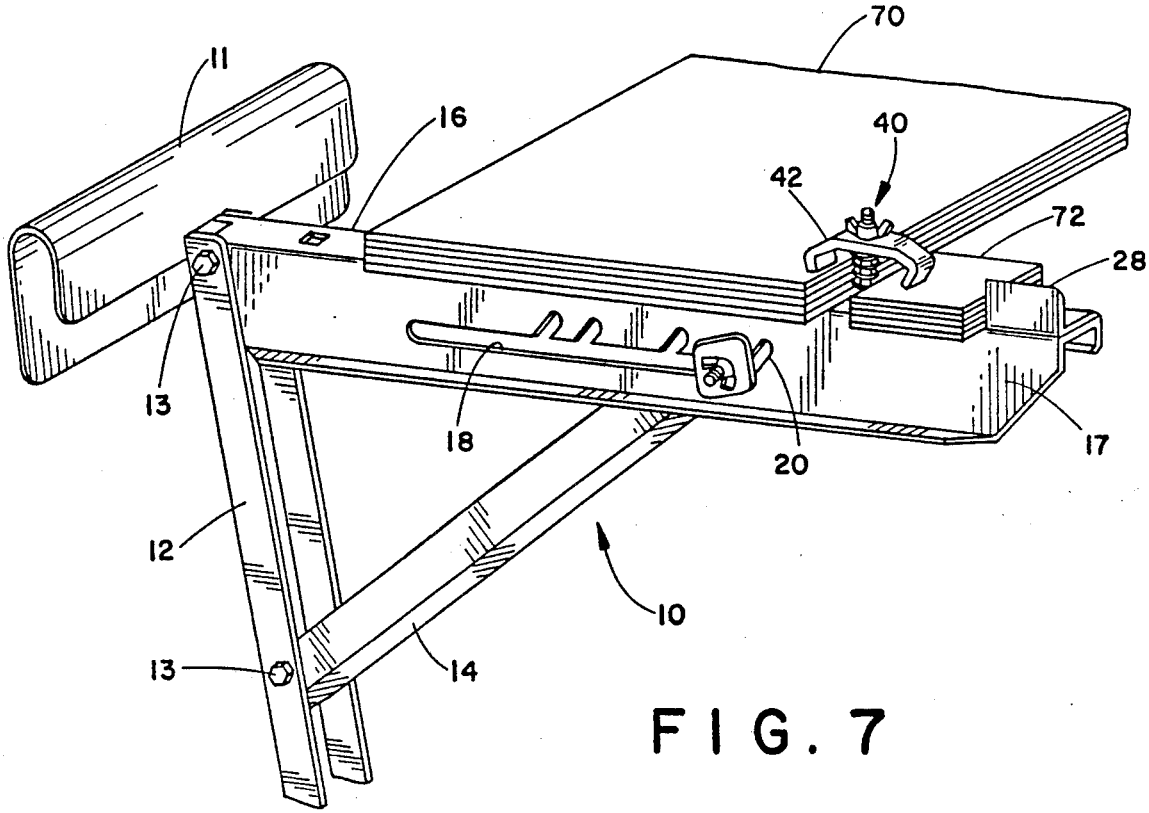
FIG. 7 is a perspective view of the ladder jack showing a further embodiment of the clamping assembly engaging a work platform plank in accordance with this invention.

Referring now to FIG. 7, a ladder jack 10 similar to the jack of FIG. 1 is shown having a clamping assembly 40 engaging a work platform comprising a thick plank 70. In this instance the inverted C-clamp 42 engages the top surface of the plank 70 but otherwise functions in the same manner as shown in FIG. 1. To balance the vertical thickness of the plank 70, a similar thickness block 72 is interposed under the C-clamp 42 and inside of the vertical stop 28 to maintain the plank 70 secure from movement in all directions and planes in accordance with this invention.

In use, a ladder scaffolding system can be easily and efficiently assembled by placing two or more laterally spaced inclined ladders against a wall, locating each ladder jack 10 on aligned ladder rungs of the respective ladders, adjusting each diagonal brace 14 relative to each respective horizontal support member 16 to substantially the same horizontal plane, and then locating the work platform 32 on the respective horizontal support members 16. The clamping assemblies are loosened and adjusted to engage the size of work platform 32 and to securely lock the same to the horizontal supporting member 16 of the ladder jack 10. The assembled ladder scaffolding can be easily and quickly dismantled and simply transported to another work site for use with the same size or different size work platforms and reassembled at the new work site in accordance with this invention.

Figure 3:
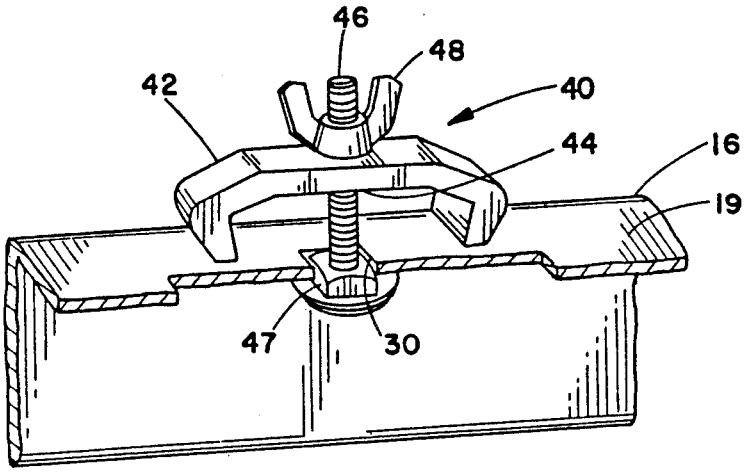
FIG. 3 is an enlarged view of the clamping assembly illustrated in FIG. 1, with parts of the ladder jack being removed for clarity.
Figure 5:
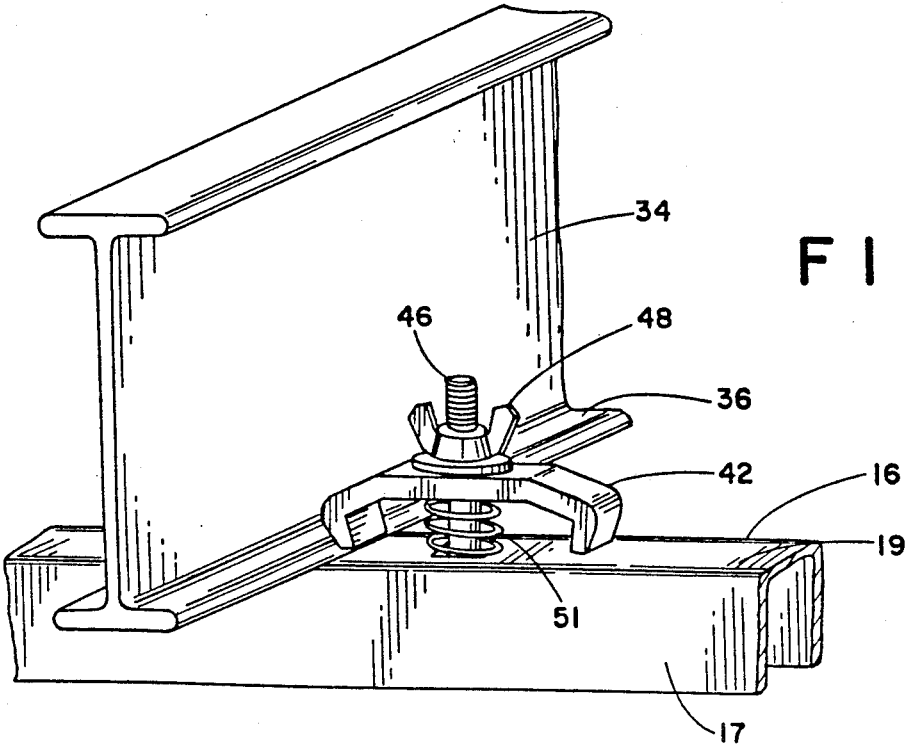
FIG. 5 is an enlarged partial perspective view of a further embodiment of the clamping assembly engaging a partial rail of the work platform, parts of the ladder jack and the work platform being removed.

With respect to the clamping assembly 40 shown in FIGS. 1, 3 and 5, the wing nut 48 can be loosened until either the inside rail flange 39 or outside rail flange 36 of the work platform 32 is engaged by the outer tip of the C-clamp 42, disposed over an edge of the rail flange and the wing nut 48 tightened to secure the platform in tight locking engagement with the ladder jack horizontal support 16 wherefor the work platform is secured against movement in any direction. The multi-hole pattern 30 in the horizontal support 16 permits variable longitudinal positioning of the inverted C-clamp 42 for securing different widths or thicknesses of work platforms 32. The square hole 30 configuration prevents the square neck carriage bolt 46 from rotating when tightening or loosening the wing nut 48 in conjunction with the compression spring 51 which ensures that the square neck head remains located within a square hole 30.

Figure 4:
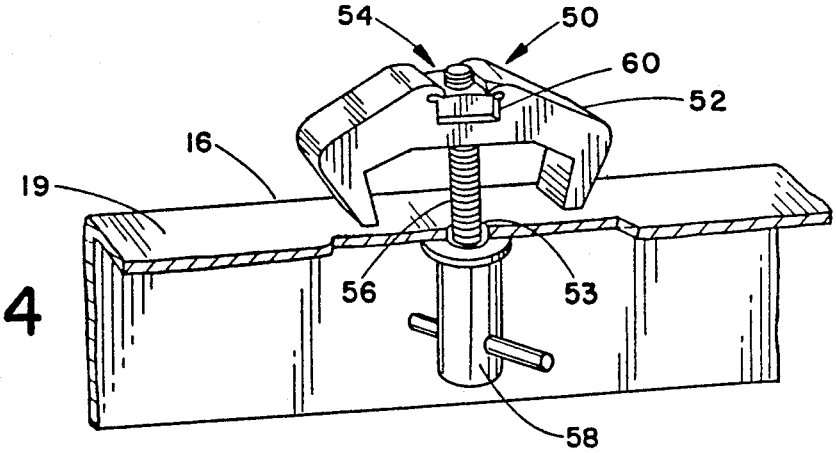
FIG. 4 is an enlarged view of the clamping assembly shown in FIG. 2 and similarly to FIG. 3 shows parts of the ladder jack removed.
Figure 6:
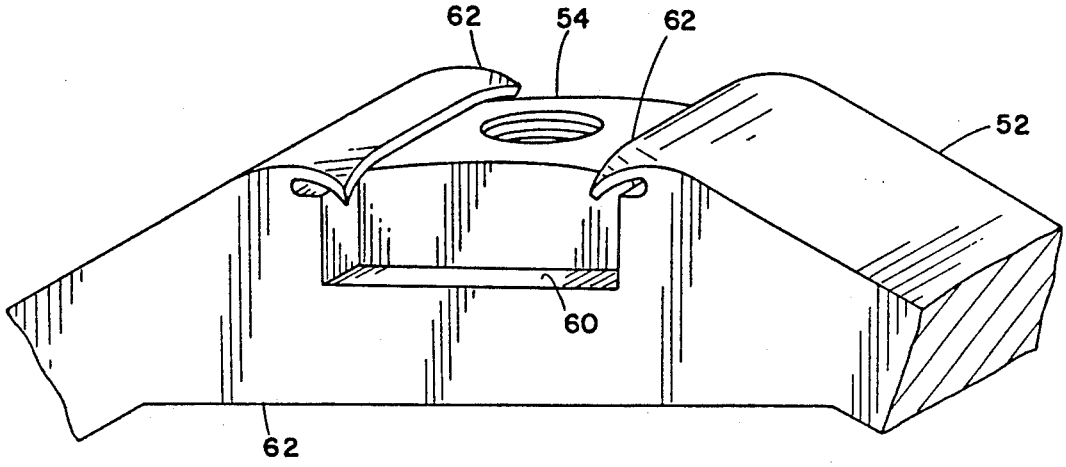
FIG. 6 is an enlarged partial perspective view of the upper portion of the clamping assembly shown in FIG. 4.

In a similar manner with respect to clamp assembly 50 shown in FIGS. 2, 4 and 6, the T-handle 58 can be rotated to loosen the C-clamp 52 whereupon the inside rail flange 39 or outside rail flange 36 can be slipped beneath the C-clamp 52. Hence, the T-handle 58 can be rotated to tighten the C-clamp 52 downwardly to securely lock the work platform 32 to the horizontal support 16 and to prevent movement of the work platform 32 in any direction or any plane in accordance with this invention. The multi-hole configuration 53 once again provides for variable longitudinal positioning of the clamping assembly 50. The recessed slot 60 centrally located in the C-clamp 52 prevents rotational movement of the square nut 54 while rotating the T-handle 58. The preferred aspect of the crimped upper surface corners 62 adjacent to square nut 54 secures the square nut 54 within the recessed slot 60 to prevent dislodgment of the square nut 54 from the clamping assembly 50.

Accordingly, both clamping assemblies 40 and 50 accommodate variable width and variable thickness work platforms 32 or 70 and prevent movements thereof in any direction while in use. The ladder jack can be easily and quickly assembled or disassembled with the accompanying ladders and work platforms without special work tools. Although the drawings and detailed description herein set forth preferred embodiments, the scope of the invention is not intended to be limited except by the appended claims.

What we claim is:

1. A ladder jack adapted to be supported by a portable inclined ladder in a ladder scaffolding system comprising two or more laterally spaced inclined ladders, where each ladder jack is adapted to support on a mid-section of each of aligned rungs of the said ladders a work platform suspended between said inclined ladders, the ladder jack comprising:

a bracket adapted to overlie each of said aligned rungs, a vertical post secured to the bracket, a horizontal support member for supporting said work platform, a diagonal brace adjustably secured to the vertical post and the horizontal support member to brace the horizontal support member, and a longitudinally movable clamping assembly for securing the work platform to the horizontal support member, said horizontal support member pivotally mounted to the upper part of the vertical post, said diagonal brace being adjustably mounted between the vertical post and the horizontal support member to permit horizontal adjustment of the horizontal support member relative to the incline of each said inclined ladder into substantially a horizontal plane, said horizontal support member containing a plurality of longitudinally spaced openings adapted to secure the movable clamping assembly in a fixed longitudinal position, the movable clamping assembly comprising an inverted C-clamp having inwardly tapered downturned tip portions at either end adapted to securely engage and lock the work platform in a longitudinally fixed position to the horizontal support member, the C-clamp including a member passing through one of the openings in the horizontal support member where rotational movement of a threaded member tightens the locking engagement of the C-clamp with the work platform and to the horizontal support member to prevent movement of the work platform in all directions and planes while in use.

2. The ladder jack in claim 1 where the member of the clamping assembly passing through an opening in the support member comprises a square head carriage bolt, and the plurality of holes in the horizontal support member are square and adapted to engage the square head of the carriage bolt to prevent rotational movement of the carriage bolt.

3. The ladder jack in claim 1 where the member passing through an opening in the support means is threaded and is engaged by a threaded tightening nut adapted to tighten or loosen the locking engagement of the inverted C-clamp against the work platform.

4. The ladder jack in claim 2 where the clamping assembly includes a spring means surrounding the threaded member and interposed between the horizontal support member and the inverted C-clamp to maintain locking engagement of the square head carriage bolt within the square hole.

* * * * *

UNITED STATES PATENT AND TRADEMARK OFFICE

CERTIFICATE OF CORRECTION

PATENT NO. : 5,020,757

DATED : June 4, 1991

INVENTOR(S) : Richard P. Sulecki; Stanley A. Kiska

It is certified that error appears in the above-identified patent and that said Letters Patent is hereby corrected as shown below:

Column 1, Line 66, between "planes" and "including" insert --,--.

Column 2, Line 26, between "tools" and "These" insert --.--

Column 3, Line 52, before "engagement" insert --easy--.

Column 4, Line 14, delete "nu" and insert thereof --nut--.

Column 4, Line 20, delete "engage" and insert thereof --engages--.

Signed and Sealed this

Twenty-second Day of September, 1992

*Attest:*

DOUGLAS B. COMER

*Attesting Officer*

*Acting Commissioner of Patents and Trademarks*